US005816870A

United States Patent [19]

Rubin

[11] Patent Number: 5,816,870

[45] Date of Patent: Oct. 6, 1998

[54] ELECTRIC DRIVE SYSTEM

[76] Inventor: Mathew Rubin, c/o Beacon Manf. Corp., Schoolhouase Rd., East Montpelier, Vt. 05651

[21] Appl. No.: 807,224

[22] Filed: Feb. 28, 1997

[51] Int. Cl.[6] ..... B63H 21/12

[52] U.S. Cl. ..... 440/6; 290/4 R; 307/84; 363/178

[58] Field of Search ..... 440/6, 7; 290/4 R; 307/84; 363/178

[56] References Cited

U.S. PATENT DOCUMENTS 4,114,555 9/1978 O'Brien ..... 440/6
5,199,912 4/1993 Dade et al. ..... 440/6

FOREIGN PATENT DOCUMENTS 4105318 8/1992 Germany ..... 440/6

*Primary Examiner*—Jesus D. Sotelo
*Attorney, Agent, or Firm*—Larson & Taylor

[57] ABSTRACT

An electric drive system for launches and sailboats utilizing standard three-phase industrial motors, directly driving low speed propellers without the use of gearboxes. The motor is driven with a standard industrial inverter and is operated in the constant torque mode to achieve the desired shaft horsepower at 30% to 40% of full motor rating. The inverter is powered by a battery bank of a series connected cells achieving a nominal voltage of 300 VDC which feeds the DC bus of the inverter directly.

5 Claims, 2 Drawing Sheets

ELECTRIC DRIVE SYSTEM

FIELD OF THE INVENTION

The present invention relates to an electric drive system and more particularly to a drive system for sailboats.

BACKGROUND OF THE INVENTION

Electric drive for launches and auxiliary drive for sail boats is coming to be increasingly popular. This is due to an increase in "no wake" rules on many lakes, as well as increasing awareness of pollution caused by marine outboards and internal combustion engines, particularly of the two-cycle variety.

For boats up to 15' or so, standard practice is to use trolling motors with 12 or 24 volt batteries. These trolling motors are limited to about ½ HP delivered to the propeller. The system described herein is not intended to replace this technology.

For larger boats the principal problem with electric drive is range. Batteries are the only commercially available and economic means of storing electric energy, and they are heavy. In order to achieve reasonable propulsion efficiencies, it is necessary to use large propellers turning slowly, as opposed to outboards or inboard combustion engines where efficiency is not a consideration, and smaller propellers turning faster is the rule. For example, a 21' hull would require about 4 HP delivered to the propeller to propel the hull at hull speed, about 7 knots. To achieve reasonable propulsion efficiency with electric drive, this hull would employ an 18" diameter propeller running at about 400 RPM. Present electric drive technology would employ 36 or 48 VDC, obtained from a bank of lead acid storage batteries. These batteries would drive, through a pulse width modulation controller, a DC motor capable of 4 HP at an output speed of 2,000 to 2,500 RPM. In order to turn the propeller, a gearbox with a 5 or 6 to 1 reduction ratio is required. The available gearboxes are noisy, and the whining sound is objectionable in an electric boat, one of whose principal features is quietness.

SUMMARY OF THE INVENTION

The principal feature of the present invention is the use of an oversized 3 phase AC motor nominally of 1,200 RPM running at approximately 400 RPM or at about 35% speed. The use of a 10 HP motor would provide the requisite torque to yield 4 HP at 400 RPM. (Other size hulls would utilize motors of different sizes.) This operating point on the AC motor is achieved through the use of a standard industrial inverter drive. These devices, which have a three-phase output with voltage and frequency declining proportionally, are routinely used to provide variable speed control for AC motors. These inverter drives can be operated to provide full torque at reduced speed. The auxiliary functions of start/stop, forward/reverse, as well as variable speed control, are all provided by the inverter.

Under usual conditions, the inverters are powered from the AC mains at 208 V three phase. Within the inverter this three phase-power is rectified to produce a nominal 300 VDC which is the internal power supply voltage for the variable voltage/frequency output. Standard inverters are designed for external DC input for backup and other functions.

The present invention could employ 24, or perhaps 26, 12 volt batteries in a series configuration to provide requisite voltage. Inasmuch as the range of a given boat is a function of stored energy in the batteries, the present invention would involve approximately the same KWH energy storage as with existing technology, but utilizing smaller batteries.

One advantage of the present invention is its quiet operation. Because the new electric boat drive has no gearbox and because the motor itself is turning at approximately 400 RPM, or 7 Hz, the use of vibration mounts for the motor and standard rubber coupling between the motor and propeller shaft will eliminate not only audible noise but any vibration.

Another advantage of the present invention is its efficiency. The overall efficiency of the standard electrical system is approximately 73%. This is obtained from a speed control of 95% efficiency, a DC motor of 82% efficiency, and a gear of approximately 94% efficiency. The present invention would have an inverter efficiency of approximately 90%, a motor efficiency of approximately 85% and no gear resulting in an overall drive efficiency of about 77%. Thus there is about a 5% improvement with the present invention.

Still another advantage of the present invention is its cost-effectiveness and convenience of use and manufacture. To a very close first approximation, the total cost of the present AC system is equal to that of the DC system. Both systems require a motor, gearbox or no gearbox, a speed control, batteries, battery charger, and similar switches and indicating meters. The AC system of the present invention, which operates at lower amperage, has the additional advantage of smaller battery cables.

Additionally, the AC system has the advantage of using off-the-shelf industrial hardware, which is available with short lead times from a multiplicity of manufacturers. The DC system involves motors available from only a few vendors and gearboxes with longer lead times. The absence of the gearbox also eliminates the mechanical complexity in coupling the gearbox to the motor. These and other features, objects and advantages of the present invention will be apparent from the drawings and detailed description.

DESCRIPTION OF THE PREFERRED EMBODIMENT

Figure 1:
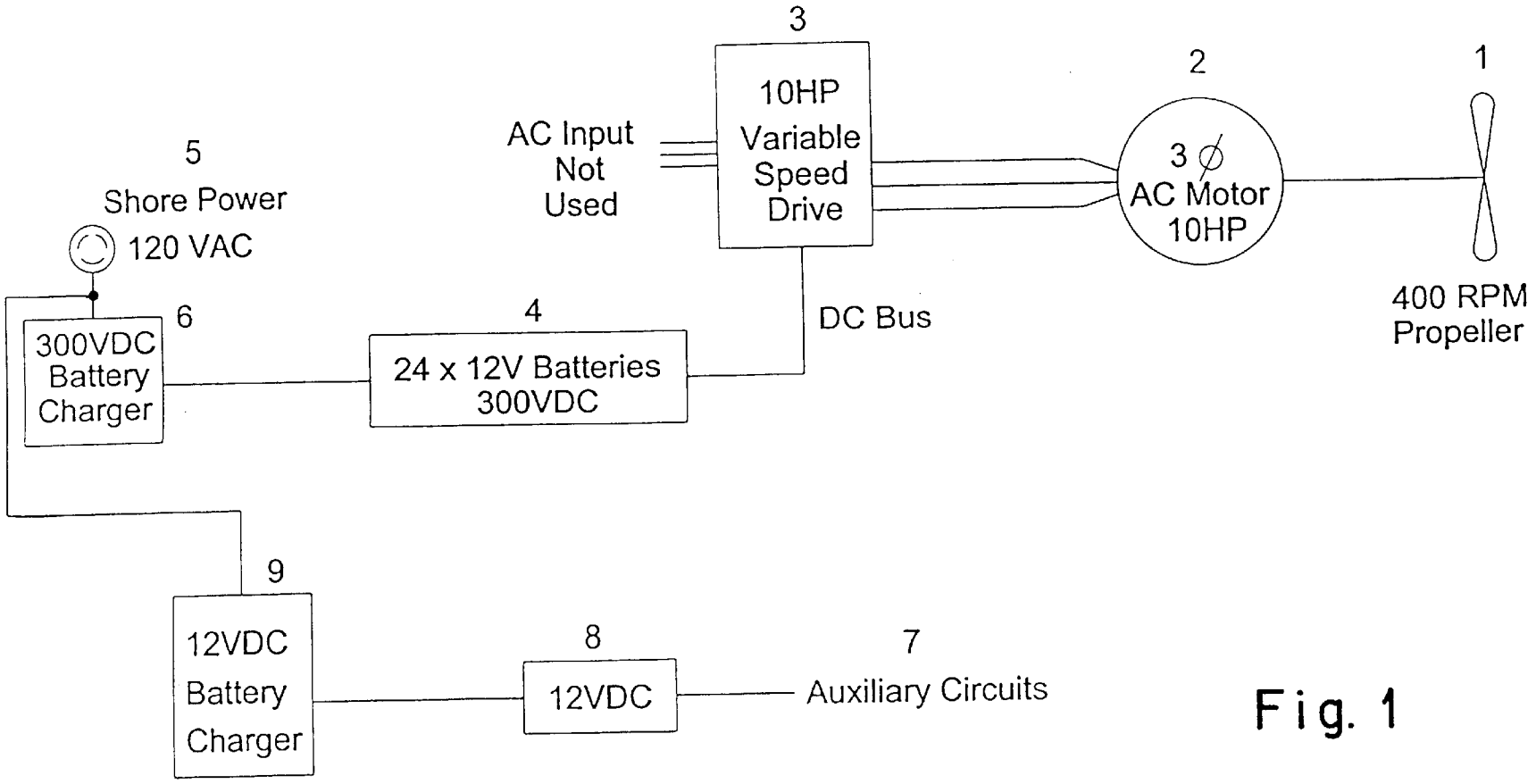
FIG. 1 schematically shows components of one embodiment of the present invention, including the battery bank, inverter, motor and direct driven propeller.

FIG. 1 is a schematic illustration of an embodiment of the present invention. The 400 RPM propeller 1 drives the boat and is driven by the three-phase AC motor 2. A variable speed AC drive 3 operates the motor 2 and provides for control of run/stop forward/reverse and speed. The variable speed drive 3 is powered by a nominal 300 VDC battery bank 4. The battery bank 4 is charged from a shore power connector 5 through a 300 VDC battery charger 6. Auxiliary circuits 7, which include running lights, communication, etc., are powered by a 12 VDC battery 8 which is charged from a 12 VDC battery charger 9.

Figure 2:
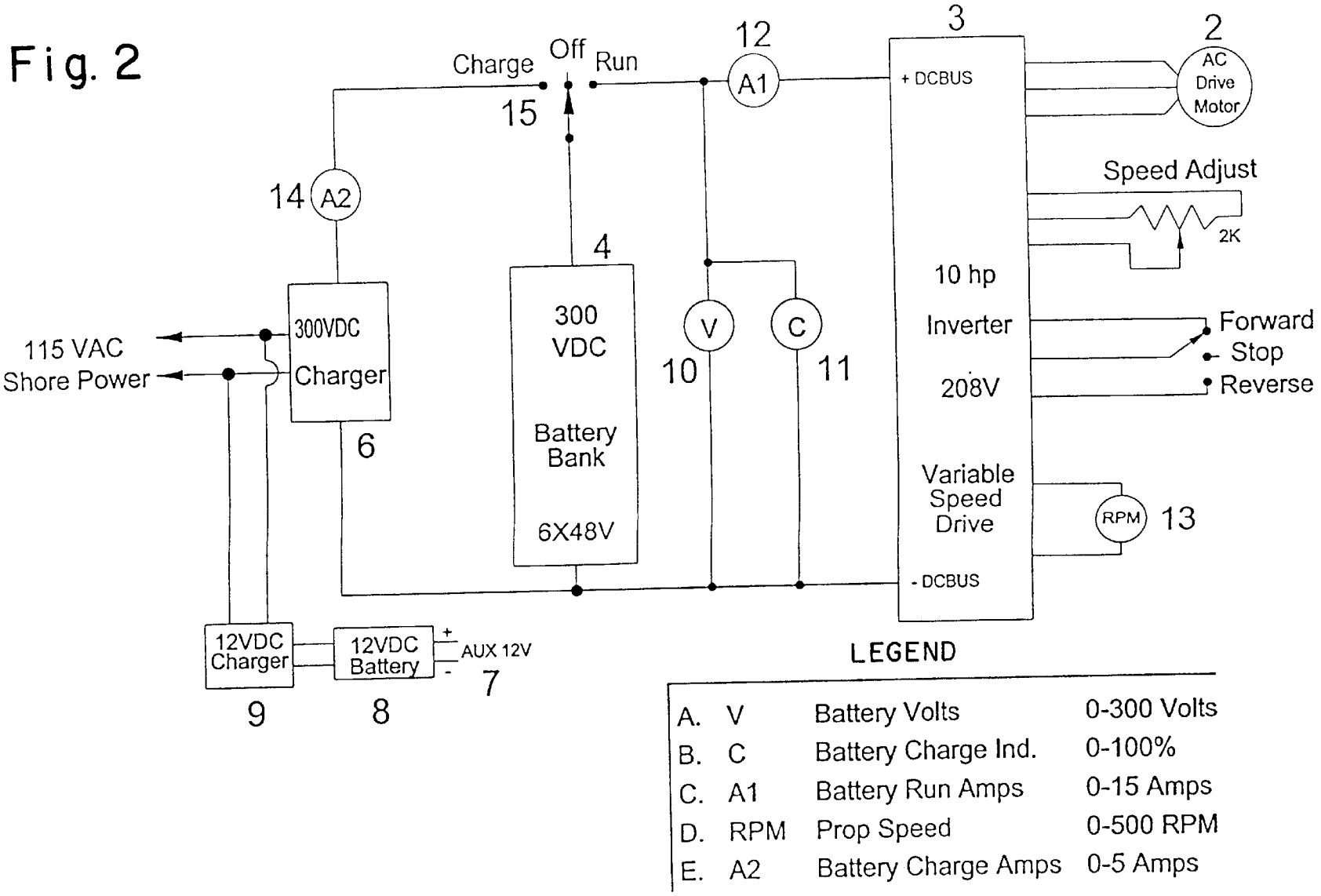
FIG. 2 shows an embodiment of the present invention with the connection of components and instrumentation.

FIG. 2 is the electric schematic of an embodiment of the present invention. Like parts bear the same numbers as FIG. 1. The AC drive motor 2 is driven from the variable speed inverter 3. The inverter 3 is powered from the 300 VDC battery bank 4, which is charged from the 300 VDC charger 6. Auxiliary circuits 7 are operated from a 12 VDC battery 8 which is charged from a 12 volt charger 9. Operation of the system is assisted by a voltmeter 10 which reads voltage on the battery bank 4. The state of the battery charge is shown by a battery charge indicator 11. The current consumed by the variable speed drive 3 is shown by an ammeter 12. The speed of the AC motor 2 is shown by an RPM meter 13, driven by the variable speed drive 3. The battery charging current is shown by an ammeter 14. The system is controlled by a key switch 15 which permits the system to either be charging or running.

One embodiment of the present invention uses: an AC motor, model number 5N316 available from WW GRAINGER a variable speed inverter, model number GPD 505 available from MAGNETEK.

Although the present invention has been described with preferred embodiments, it is to be understood that modifications and variations may be resorted to without departing from the spirit and scope of the invention as those skilled in the art would readily understand. Such variations and modifications are considered to be within the purview and scope of the appended claims.

I claim:

1. An electric drive system for sailboats comprising:

a. a DC power source;

b. an inverter connected to said DC power source, said inverter having a three-phase output with voltage and frequency changing proportionally;

c. a three-phase AC motor with an output shaft connected to a propeller, said AC motor connected to said output of said inverter, said AC motor nominally having 1,200 RPM, said inverter and said AC motor being constructed and arranged to operate at about 400 RPM and to yield 4 HP to said output shaft; and d. controls connected to said inverter for start and stop, forward and reverse and variable speed operation of said drive system.

2. The method of propelling boats comprising:

a. providing said boat with a three-phase AC electric motor having a shaft directly connected to a propeller, said motor being connected to the output of an inverter which provides a three-phase output with voltage and frequency changing proportionally, said inverter being connected to a plurality of DC batteries connected in series to provide output voltage to said inverter;

b. operating said motor in a constant torque mode to obtain desired output horsepower on said shaft at 30–40% of the full motor rating.

3. An electric drive system for sailboats comprising:

a. a means for providing a DC power source;

b. an inverter means connected to said DC power source means, said inverter means having a three-phase output with voltage and frequency changing proportionally;

c. a three-phase AC motor means with an output shaft connected to a propeller, said AC motor means connected to said output of said inverter means, said AC motor means nominally having 1,200 RPM, said inverter means and said AC motor means being constructed and arranged to operate at about 400 RPM and to yield 4 HP to said output shaft; and d. control means connected to said inverter means for start and stop, forward and reverse and variable speed operation of said drive system.

4. The invention of claims 1 or 3 wherein said DC power source is a nominal 300 volt DC battery bank.

5. The invention of claim 2 wherein said AC motor is operated at about 400 RPM.

* * * * *